United States Patent [19]

Raud

[11] 4,146,594

[45] Mar. 27, 1979

[54] FUEL FLOW CONTROL DEVICE

[76] Inventor: Jean Raud, Residence Concord Bat D, 4 Avenue President Roosevelt, 19 100 Brive la Gaillarde, France

[21] Appl. No.: 886,641

[22] Filed: Mar. 15, 1978

Related U.S. Application Data

[63] Continuation-in-part of Ser. No. 718,670, Aug. 30, 1976, abandoned.

[30] Foreign Application Priority Data

Jul. 10, 1975 [FR] France ..... 75 30627
Apr. 6, 1976 [FR] France ..... 76 16913
Apr. 6, 1976 [FR] France ..... 76 16913

[51] Int. Cl.[2] ..... F02M 3/04

[52] U.S. Cl. ..... 261/41 D; 261/DIG. 19; 123/97 B; 251/337; 251/356; 137/625.12

[58] Field of Search ..... 261/DIG. 19, 41 D, 69 R; 123/97 B

[56] References Cited

U.S. PATENT DOCUMENTS

| | | | |
|---|---|---|---|
| 2,214,964 | 9/1940 | Leibing | 261/DIG. 19 |
| 2,824,725 | 2/1958 | Dietrich | 261/DIG. 19 |
| 2,879,756 | 3/1959 | Cornelius | 261/DIG. 19 |
| 2,981,279 | 4/1961 | Beck | 261/DIG. 19 |
| 3,042,387 | 7/1962 | King | 261/DIG. 19 |
| 3,354,898 | 11/1967 | Barnes | 123/97 B |
| 3,795,237 | 3/1974 | Denton | 261/DIG. 19 |
| 3,906,909 | 9/1975 | Garcea | 261/DIG. 19 |
| 3,952,076 | 4/1976 | Chatelain et al. | 123/97 B |

FOREIGN PATENT DOCUMENTS

| | | | |
|---|---|---|---|
| 727633 | 3/1932 | France | 261/DIG. 19 |
| 786413 | 11/1957 | United Kingdom | 123/97 B |

*Primary Examiner*—Tim R. Miles
*Attorney, Agent, or Firm*—Burgess, Ryan and Wayne

[57] ABSTRACT

A fuel control device is adapted to be used in the place of the conventional pilot jet of the carburetor of an internal combustion engine. This device comprises a chamber defining first and second valve seats, as well as a double-acting movable valve member cooperating alternatively with said valve seats. The chamber is connected by the first valve seat to a fuel inlet, and by the second valve seat to an air inlet, and its wall has openings by means of which said chamber may be interposed in a low-pressure conduit connected to the carburetor. Means are provided for maintaining the valve head in an intermediate position, i.e. out of engagement with said first and second valve seats, when the engine runs at idling speed, and for moving the valve head into engagement with the first valve seat when the engine runs at an increased speed, while moving the valve head into engagement with the second valve seat when the engine runs at a very low speed, whereby the fuel flow controlled by the device is interrupted each time the engine runs at a speed different from the idling speed.

9 Claims, 5 Drawing Figures

FUEL FLOW CONTROL DEVICE

This is a continuation-in-part of U.S. patent application Ser. No. 718,670 filed on Aug. 30, 1976 by Jean RAUD, now abandoned.

The present invention is related to a fuel flow control device adapted to replace the conventional idling jet or pilot jet used in a manner known per se on the carburetor of an internal combustion engine, such as an automobile engine, which carburetor comprises a float chamber, a throttle valve interposed between a carbureting chamber and the air-fuel mixture inlet of said engine, a fuel inlet conduit connecting said float chamber to a threaded hole adapted to receive selectively said pilot jet or said control device, and a low pressure conduit connecting said carbureting chamber to said air-fuel mixture inlet. The flow control device according to the invention comprises a body provided with an externally threaded portion adapted to be screwed into said threaded hole, said body further comprising adjacent to an end thereof, which is adapted to be introduced into said threaded hole, a substantially cylindrical chamber defining a first valve seat at one end thereof into which opens a calibrated passage adapted so as to connect said cylindrical chamber to said fuel inlet conduit, said cylindrical chamber defining at the other end thereof a second valve seat communicating with a laterally disposed passage adapted to be interposed in said low-pressure conduit, a movable valve member being mounted within said cylindrical chamber and adapted to cooperate alternatively with said first and second valve seats, said device further comprising control means adapted to control said valve member so that the latter is disengaged from both said first and second valve seats when said engine operates at idling speed with said throttle valve in the closed position thereof, said valve member engaging said first valve seat when said engine operates at an increased speed after said throttle valve has been moved from the closed position thereof to an open position, and said valve member engaging said second valve seat when said engine operates at a decreasing speed after said throttle valve has been moved from an open position to the closed position thereof.

It will be understood that, due to this arrangement, fuel is fed through the novel control device to the engine substantially only when the latter operates at idling speed, whereas the fuel flow through said control device toward the engine is decreased or interrupted when the latter operates either at increased or at decreased speed. Thus the novel control device allows considerable amounts of fuel to be saved, and the combustion to be improved, whereby the pollution of the atmosphere by noxious components of the exhaust gases is considerably reduced.

In one embodiment of the instant invention, said second valve seat is connected to an axial bore opening into a cylindrical space defined within said body, which cylindrical space has a diameter larger than that of said chamber, while said valve member is constituted by a valve head having opposed first and second end faces cooperating with said first and second valve seats, respectively, said valve head being integrally connected to one end of a cylindrical stem coaxially extending through said axial bore and into said cylindrical space in said body, the diameter of said stem being substantially smaller than that of said bore, the other end of said stem being provided with a piston-like member submitted to the action of a return spring mounted within said cylindrical space, said piston-like member having one end face exposed to atmospheric pressure and being tightly and slidably mounted in said cylindrical space, said laterally disposed passages opening into said axial bore at substantially diametrically opposed locations thereof, and the force of said return spring being such that under low-pressure conditions occuring when said engine operates at idling speed with said throttle valve in its closed position, said valve head is placed in a position between said first and second valve seats, with none of said end faces of said head in contact with the associated valve seat, while under low-pressure conditions occuring when said engine operates at an increased speed with said throttle valve in a substantially open position, said first end face of the valve head engages said first valve seat, whereas said second end face of the valve head engages said second valve seat under low-pressure conditions occuring when said engine operates at decreasing speed when said throttle valve has been moved from its open position to its closed position.

In a particularly advantageous embodiment of the instant invention, the device comprises means for introducing supplementary air into the inner space of said device.

These means for introducing supplementary air are constituted, in a preferred embodiment, by at least one through-hole provided in said piston-like member and connecting said cylindrical space to the atmosphere.

In yet another advantageous embodiment of the invention, means are provided for submitting said valve head and said stem integral therewith to a rotational motion.

The above mentioned means for rotating said valve head and stem are advantageously constituted by at least one through-hole provided in said piston-like member and inclined with respect to a plane containing the geometrical axis of said piston-like member and of said stem.

Advantageously this inclined through-hole may be of a substantially helical configuration.

In another preferred embodiment, the first end face of said valve head is provided with at least one small transverse slot defining axially projecting portions of said valve head. This arrangement is advantageous in that it prevents the valve head from undergoing flutter when said first end face thereof engages said first valve seat.

The invention will now described in more detail with reference to the appended Figures which show several embodiments of the novel device by way of example, but not of limitation.

Figure 1:
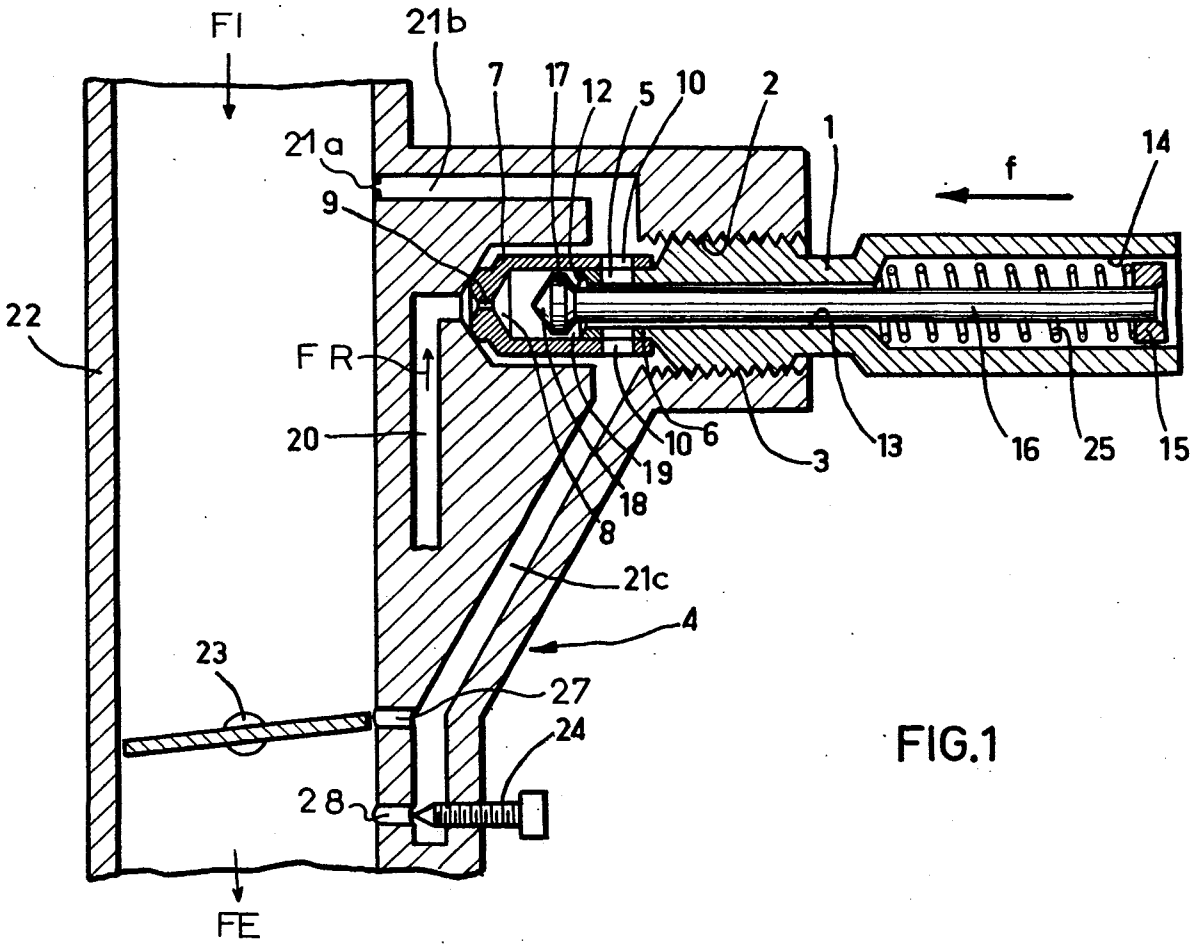
FIG. 1 shows an embodiment of the fuel flow control device according to the invention, in longitudinal section.

The fuel flow control device shown in FIG. 1 comprises a body 1 provided with an external threaded portion 2 allowing the body 1 to be screwed into a threaded hole 3 of a carburetor 4 (shown schematically), which hole 3 is normally provided for receiving, in a manner know per se, an idling jet or pilot jet. The carburetor 4 is associated to an internal combustion engine, such as an automobile engine.

Body 1 has at one of its ends a cylindrical portion 6 onto which is fitted a tubular casing 7 provided at one of its ends with a first valve seat 8 into which opens a calibrated passage 9, while adjacent its other end said tubular casing 7 is provided with two diametrically opposed, laterally disposed passages 10 which are in register with corresponding lateral passages 5 provided in the cylindrical portion 6.

The free end of cylindrical portion 6 is provided with a second valve seat 12, and body 1 comprises a cylindrical bore 13 extending in an axial direction and opening into a cylinder 14 the inner diameter of which is slightly larger than that of tubular casing 7.

A piston, or piston-like member 15, integral with a stem 16 is slidingly mounted in the cylinder 14, said stem 16 being capable of moving slidingly in the cylindrical bore 13 and being provided at its end opposite the piston 15 with a valve head 17 having a configuration such that it forms a first valve surface 18 adapted to cooperate with the above mentioned first valve seat 8, and a second valve surface 19 adapted to cooperate with the second valve seat 12. Valve head 17 and the inner wall of casing 7 define between themselves an interval through which fluid can flow along valve head 17.

When the device is mounted on the carburetor the calibrated passage 9 is in register with the fuel inlet conduit 20 of the carburetor, which conduit is connected to the float chamber (not shown) of said carburetor, while the lateral passages 5 are located in a conduit **21*b*, 21*c* one end of which opens through an aperture 21*a* into the upper part of the carbureting chamber 22, said conduit 21*b*, 21*c* opening at its other end into the air-fuel mixture inlet 28 downstream of the throttle 23, a taper-end screw 24** being provided, as shown, in the resulting flow path for adjusting the air-fuel mixture flow rate when the engine operates at idling speed.

As shown in the Figure, stem 16 has a diameter smaller than the inner diameter of bore 13, so as to be able to slide freely while defining an annular interval between said stem and the inner wall of said bore for allowing air to flow through said bore, as will be explained herein after.

A compression spring 25 is mounted within cylinder 14; this spring is selected and dimensioned in such a manner that, when the engine does not operate, valve surface 19 of valve head 17 at least substantially seals the valve seat 12, without being applied, however with an excess force against said seat 12.

The device described herein above operates as follows:

When the internal combustion engine is being started or "cranked", with throttle valve 23 substantially in its closed position, air is drawn by the engine through aperture **21*a*, upstream portion 21*b* of conduit 21*b*, 21*c* (which upstream portion is defined between aperture 21*a* and passages 10, 5) downstream portion 21*c* of said conduit (defined between passages 5, 10 and inlet 28) and flows into the carburetor portion located downstream of throttle valve 23, said air being initially aspirated into the carburetor in the direction of arrow FI, and finally delivered to the engine in the direction of arrow FE. While the air flows through the passages 5 and 10 permanently connected to the cylindrical bore 13 of the control device, it produces a slight decrease of the pressure within said bore, with respect to the atmospheric pressure permanently acting on piston-like member 15. Consequently valve surface 19 of valve head 17 will move away a comparatively small distance from valve seat 12, against the action of calibrated spring 25, whereby the decreased pressure will also prevail in the inner space of tubular tubing 7. Under the effect of such decreased pressure, fuel will be drawn into said casing through calibrated passage 9 and will be mixed with the air and aspirated in the form of air-fuel mixture through downstream conduit portion 21*c* and inlet 28 toward the engine. During this starting or cranking phase, the pressure decrease within the control device is comparatively small, so that, due to the calibration of spring 25, the valve surface 19 of valve head 17 substantially will take a position at a small distance from valve seat 12, such that the fluid passage section defined between valve surface 19 and valve seat 12 is smaller than the passage section defined between stem 16 and the wall of cylindrical bore 13 provided in the cylindrical body 1 of the control device. It will be understood that under these conditions the valve assembly formed by valve surface 19 and valve seat 12** acts as a metering valve, whereby a convenient metered amount of atomized fuel carried by the above-mentioned stream of air is delivered to the engine which is consequently enabled to operate at idling speed.

When throttle valve 23 is then placed in a slightly opened position wherein a certain amount of air flows through carbureting chamber 22 in the direction of arrows FI and FE, without being able yet to prime the emulsifier of the carburetor i.e. without carrying atomized fuel provided by said emulsifier, a condition results wherein the pressure inside carbureting chamber 22 and consequently inside the control device will further decrease, whereby the valve body 17 is further moved away from valve seat 12 toward a position intermediate between seats 12,8 and thus allows a maximum amount of fuel to be aspired through calibrated passage 9 and to be delivered to the engine, enabling the latter to operate at a speed higher than the idling speed.

Further opening throttle valve 23 -e.g. placing the latter in its entirely open position- results in a substantially increased rate of air flow through carbureting chamber 22. The emulsifier of the carburetor is primed and the engine is fed with air-fuel mixture flowing in the direction of arrows FI and FE. The pressure prevailing in carbureting chamber 22 and consequently within the control device further decreases as the speed of the engine increases as a function of the increased amount of fuel fed thereto; as a result of this decreased pressure the atmospheric pressure acting on piston-like member 15 causes the latter to be further displaced together with stem 16 and valve head 17 toward valve seat 8 until valve surface 18 engages said valve seat 8, thus preventing fuel to flow through calibrated passage 9 into the control device.

When the throttle is then moved again into its closed position with a view to reducing again the speed of the engine, the pressure suddenly increases in the upstream portion **21*a* of conduit 21*a*, 21*b*, whereas a comparatively strong vacuum prevails downstream of the closed throttle valve 23, as during an initial phase the engine continues to operate at high speed, under the effect of inertia, even though the flow of air-fuel mixture through the carbureting chamber toward the engine is now interrupted by said throttle valve. Under the effect of said sudden pressure increase (i.e. sudden suppression of the vacuum which has previously prevailed) the assembly of piston-like member 15, stem 16 and valve head 17 is suddenly brought back by spring 25 into the position wherein valve surface 19 engages valve seat 12, thus preventing fuel from being drawn through passage 9 into conduit portion 21 and toward the engine. During this initial decelerating phase a certain residual amount of air-fuel mixture may still be present in conduit portion 21***c*. Under the effect of the vacuum prevailing downstream of throttle valve 23 such residual air-fuel mixture will be aspired through aperture 28 into the engine, whereafter said vacuum will be transmitted to the inner space of the control device, as long as the speed of the engine operating by inertia remains comparatively high. Due to this vacuum, or pressure decrease, valve head 17 will be moved toward valve seat 8 and possibly, or eventually, valve surface 18 will engage valve seat 8 and thus prevent fuel from flowing through passage 9 into the control device and hence into the engine, until the decreasing speed of the latter has reached again the idling speed value, whereby the pressure within the control device reaches again the value corresponding to said idling speed; during this deceleration phase the valve head will move back toward valve seat 12 until it reaches the above-described position wherein valve surface 19 is located at a small distance from valve 12 and wherein the valve assembly constituted by valve head 17 and valve seat 12 acts as a metering valve delivering a convenient amount of fuel to the idling engine.

FIG. 1 shows an opening 27 connecting conduit portion 21*c* to carbureting chamber 22 and adapted to be substantially sealed by throttle valve 23 when the latter is in its closing position; such opening 27 is provided for draining and similar purposes in many conventional carburetors, and it has no substantial influence on the operation of the control device according to the invention; the function of opening 27 consequently needs not be described in detail herein.

It will be understood from the preceding that the novel device allows considerable amounts of fuel to be saved, on the one hand when the speed of the engine is increased, as the device then cuts off the idling fuel flow, and on the other hand when the speed of the engine is decreased, as idling fuel is allowed to be admitted substantially only after the speed of the engine corresponds again to the idling speed.

The embodiment shown in FIG. 2 has a structure fundamentally similar to that of the embodiment described herein above, and consequently the same reference numerals have been used in both FIGS. 1 and 2 for designating identical or similar parts. However the embodiment of FIG. 2 is distinct from de preceding one in that it comprises means for introducing supplementary air into the control device.

In one variant the supplementary air is introduced into the cylindrical bore 13 through at least one hole 26 provided in the wall of the body 1.

It has been observed that, due to the introduction of supplementary air, the pollution of the atmosphere by the exhaust gases of the associated internal combustion engine was considerably reduced. For example, it has been experimentally established that, for a given automobile engine equipped with the novel control device provided with supplementary air inlet means, the carbon monoxide content of the exhaust gases was 0.2%, as compared to 4% for the same engine equipped with a conventional idling or pilot jet.

Figure 2:
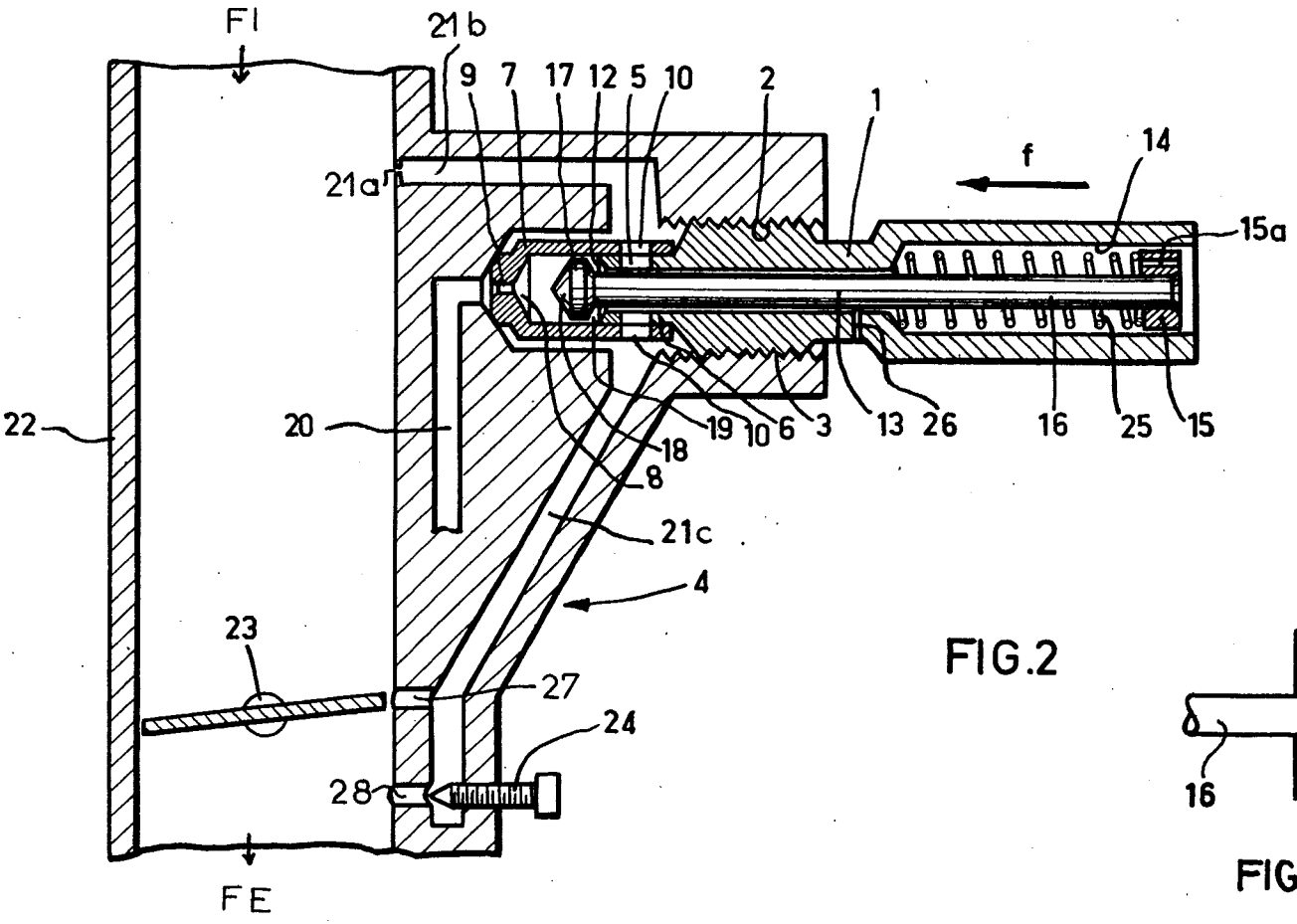
FIG. 2 shows another embodiment of the novel device, also in longitudinal section.

In another variant of the embodiment shown in FIG. 2 supplementary air is introduced into the device through at least one through-hole 15*a* provided in piston 15.

Figure 3:
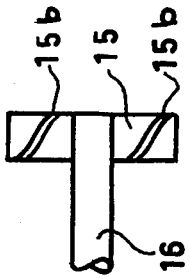
FIG. 3 is a sectional view of a detail of the novel device according to yet another embodiment.
Figure 4:
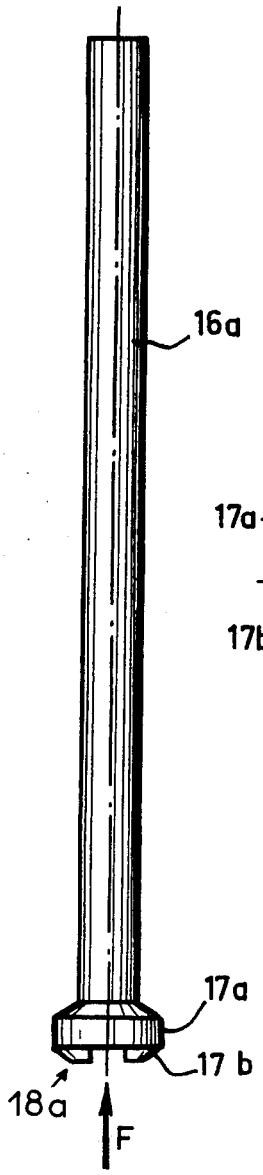
FIG. 4 is a longitudinal section of the stem and the valve head integral therewith, as used in a preferred embodiment of the novel device.

The assembly comprising piston 15, stem 16 and valve head 17 may be rotated by convenient means with a view to allowing the fuel to be more uniformly distributed on the surfaces it encounters when flowing through the device, whereby a more efficient evaporation is achieved. The rotational motion of said assembly may be obtained advantageously by means of supplementary air inlet holes provided in piston 15 which are inclined with respect to an axial medium plane of the piston, and/or helically shaped, as shown at 15*b* in FIG. 3, said holes being submitted to the effect of the supplementary air entering the device, so as to act in a manner comparable to that of the blades of a turbine of the like.

Figure 5:
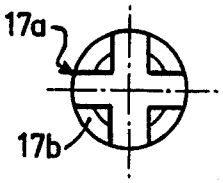
FIG. 5 is a schematic end view of the valve head shown in FIG. 4.

Projections 17*b* of valve head 17*a*, an end view of which is represented in FIG. 5, are useful in that they cause the fuel to rotate, when the above mentioned stem and valve head assembly is rotated as described, thus enhancing the above mentioned advantageous effects of the rotation of said assembly.

It will be understood that another advantageous effect of the rotational motion of the stem and valve head assembly resides in the self-cleaning action produced by this rotation; indeed, by rotating as described, the said assembly prevents solid impurities from being accumulated within the control device.

It should be noted that in all the embodiments of the device according to the invention, the fuel, when penetrating the device through calibrated passage 9, encounters the valve head 17 before it flows along the portion of the stem 16 adjacent said valve head. Consequently the fuel presents a considerable surface area, which enhances the vaporization in the air circulating in this zone of the device.

The invention is not limited to the embodiments described and shown herein. As one skilled in the art will easily understand, many modifications may be envisaged within the scope of the invention, particularly as defined in the appended claims.

What is claimed is:

1. A fuel flow control device adapted to replace the conventional pilot jet used on the carburetor of an internal combustion engine, such as an automobile engine, which carburetor comprises a float chamber, a throttle valve interposed between a carbureting chamber and the air-fuel mixture inlet of said engine, a fuel inlet conduit connecting said float chamber to a threaded hole adapted to receive selectively said pilot jet or said control device, and a low pressure conduit connecting said carbureting chamber to said air-fuel mixture inlet, said fuel flow control device comprising a body provided with an externally threaded portion adapted to be screwed into said threaded hole, said body further comprising adjacent to its end thereof, which is adapted to be introduced into said threaded hole, a substantially cylindrical chamber defining a first valve seat at one end thereof into which opens a calibrated passage adapted so as to connect said cylindrical chamber to said fuel inlet conduit, said cylindrical chamber defining at the other end thereof a second valve seat communicating with a laterally disposed passage adapted to be interposed in said low-pressure conduit, a movable valve member being mounted within said cylindrical chamber and adapted to cooperate alternatively with said first and second valve seats, said device further comprising control means adapted to control said valve member so that the latter is disengaged from both said first and second valve seats when said engine operates at idling speed with said throttle valve in the closed position thereof, said valve member engaging said first valve seat when said engine operates at an increased speed after said throttle valve has been moved from the closed position thereof to an open position, and said valve member engaging said second valve seat when said engine operates at a decreasing speed after said throttle valve has been moved from an open position to the closed position thereof.

2. The device according to claim 1, wherein said second valve seat is connected to an axial bore opening into a cylindrical space provided within said body, which cylindrical space has a diameter larger than that of said bore, while said valve member comprises a valve head having mutually opposed first and second end faces cooperating with said first and second valve seats respectively, said valve head being integrally connected to one end of a cylindrical stem coaxially extending through said axial bore and into said cylindrical space, the diameter of said stem being substantially smaller than that of said bore, said control means comprising a piston-like member provided on the other end of said stem and tightly and slidably mounted in said cylindrical space, said piston-like member having the free end surface thereof exposed to atmospheric pressure, said control means further comprising a return spring mounted within said cylindrical space for urging said stem towards a position wherein said second valve head end face engages said second valve seat, said return spring being calibrated so that under low-pressure conditions occurring within said carbureting chamber, and thus within said control device, when said engine operates at idling speed with said throttle valve in the closed position thereof, said valve head is placed in an intermediate position between and out of engagement with said first and second valve seats, while under low-pressure conditions occuring in said carbureting chamber, and thus within said control device, when said engine operates at an increased speed after said throttle valve has been moved from the closed position to an open position thereof, said first valve head end face engages said first valve seat, whereas under low-pressure conditions occuring within said carbureting chamber, and thus within said control device, when said engine operates at a decreasing speed after said throttle valve has been moved from an open position to the closed position thereof, said second valve head end face engages said second valve seat.

3. The device according to claim 2, further comprising means for introducing supplementary air into the inner space of said device.

4. The device according to claim 3, wherein said means for introducing supplementary air comprise at least one through-hole provided in said piston-like member for communicating said cylindrical space to the atmosphere.

5. The device according to claim 3, wherein said means for introducing supplementary air comprise at least one passage hole provided in the wall of the body of said device for communicating the inner space of the latter to the atmosphere.

6. The device according to claim 1, further comprising means for rotating said valve head and said stem integral therewith.

7. The device according to claim 6, wherein said means for rotating said valve head and said stem integral therewith comprise at least one through-hole provided in said piston-like member and inclined with respect to a plane containing the geometrical axis of said piston-like member.

8. The device according to claim 7, wherein said inclined through-hole has a substantially helical configuration.

9. The device according to claim 2, wherein said first end face of said valve head is provided with at least one transverse slot defining axially projecting portions of said valve head.

* * * * *